US005289772A

United States Patent [19]

Kohara et al.

[11] Patent Number: 5,289,772

[45] Date of Patent: Mar. 1, 1994

[54] INK FOUNTAIN APPARATUS FOR PRINTING PRESS

[75] Inventors: Kazutaka Kohara; Shuntaro Sugawara, both of Chiba, Japan

[73] Assignee: Komori Corporation, Japan

[21] Appl. No.: 947,402

[22] Filed: Sep. 18, 1992

[30] Foreign Application Priority Data

Sep. 19, 1991 [JP] Japan ..... 3-83720

[51] Int. Cl.[5] ..... B41F 31/04; B41F 31/06; B41F 27/08

[52] U.S. Cl. ..... 101/351; 101/363

[58] Field of Search ..... 101/350, 365, 363, 351, 101/352, 207-209, 210, 148

[56] References Cited

U.S. PATENT DOCUMENTS

| | | | |
|---|---|---|---|
| 2,821,919 | 2/1958 | Dressel | 101/365 |
| 4,502,386 | 3/1985 | Cappel et al. | 101/350 |
| 5,111,747 | 5/1992 | Kobler et al. | 101/365 |

FOREIGN PATENT DOCUMENTS

| | | |
|---|---|---|
| 59-41269 | 3/1984 | Japan . |
| 2-184439 | 7/1990 | Japan . |
| 2145973 | 4/1985 | United Kingdom . |

*Primary Examiner*—J. Reed Fisher

*Attorney, Agent, or Firm*—Blakely, Sokoloff, Taylor & Zafman

[57] ABSTRACT

An ink fountain apparatus for a printing press includes an ink fountain roller, an ink fountain, follow-up bearings, and springs. The ink fountain roller supplies a printing ink to a plate cylinder. The ink fountain has an ink blade disposed to have a predetermined gap with the circumferential surface of the ink fountain roller and movable forward and backward to approach to and separate from the circumferential surface of the ink fountain roller. The follow-up bearings are fixed to the ink fountain and contact the circumferential surface of the ink fountain roller to follow up a shape of the circumferential surface of the ink fountain roller. The springs bias the ink fountain toward the circumferential surface of the ink fountain roller.

3 Claims, 3 Drawing Sheets

INK FOUNTAIN APPARATUS FOR PRINTING PRESS

BACKGROUND OF THE INVENTION

The present invention relates to an ink fountain apparatus for a printing press which causes an ink in an ink fountain to flow out continuously by a predetermined amount.

An inking arrangement for supplying a printing ink to a plate mounted on the plate cylinder of an offset rotary press comprises an ink fountain apparatus for causing the ink stored in its ink fountain to flow out by a predetermined amount, and a large number of rollers for transferring the flowed ink while smoothing it in respective directions, thus supplying the ink to the plate surface. FIG. 3 shows the arrangement of the above conventional ink fountain apparatus. More specifically, referring to FIG. 3, an ink fountain roller 1 is rotated in a direction indicated by an arrow. Stays 2 and 3 each having almost the same length as that of the ink fountain roller 1 are disposed obliquely below the ink fountain roller 1, and a blade table 4 having the same length as that of the ink fountain roller 1 is mounted on the stay 2 by bolts 5. An ink blade 6 constituted by a thin stainless steel plate and having the same length as that of the ink fountain roller 1 is mounted on the blade table 4 by screws such that its distal end is very close to the cylinder surface of the ink fountain roller 1. Triangular ink embankments 7 are provided at two end portions of the ink blade 6. An L-shaped adjustment piece 8 is pivotally mounted on the other stay 3, and an adjustment screw 9 is screwed in the adjustment piece 8. An ink 10 is stored in the ink fountain defined by the ink fountain roller 1, the ink blade 6, and the two ink embankments 7. As the ink fountain roller 1 is rotated, the ink 10 flows out through the gap between the ink fountain roller 1 and the ink blade 6 to form an ink film on the surface of the ink fountain roller 1. The ink film thickness, i.e., the amount of ink to be supplied to the plate is adjusted by manually rotating the adjustment screw 9 forward or backward to elastically deform the ink blade through the adjustment piece 8, thus adjusting the gap between the distal end of the ink blade 6 and the circumferential surface of the ink fountain roller 1.

The printing speed of the offset printing press has been increased recently. Accordingly, a variation occurs in ink transfer due to the thermal deformation of a rubber roller that generates heat under a high-speed operation. Also, since an ink ductor generates heat as it performs reciprocal rotating movement with quick deceleration and quick acceleration, the ink fountain roller contacting the ink ductor is thermally deformed. As a result, the thickness of the ink film varies to decrease the printing density.

In order to solve this problem, Japanese Patent Laid-Open Nos. 59-41269 and 2-184439 propose a technique to set constant the thickness of the ink film.

Referring to FIG. 3, the ink fountain apparatus for a printing press proposed in these gazettes further comprises an adjustment roller or rod for contacting the circumferential surface of the ink fountain roller or the bearing bush of the ink fountain roller. Thermal deformation of the ink fountain roller or the bearing bush of the ink fountain roller is extracted through the adjustment roller or rod, and the ink fountain is rotated about a support shaft 11 shown in FIG. 3 on the basis of the extracted change component corresponding to the deformation, thus maintaining the gap between the circumferential surface of the ink fountain roller and the ink blade at a constant value.

In the conventional ink fountain apparatus for the printing press described above, however, as the deformation of the ink fountain roller is temporarily converted to a rotational moving amount of the ink fountain and then to the linear moving amount of the ink blade, the deformation amount of the ink fountain roller and the moving amount of the ink blade with respect to the circumferential surface of the ink fountain roller do not precisely coincide with each other. Hence, it is difficult to maintain the gap between the circumferential surface of the ink fountain roller and the ink blade at a constant value.

SUMMARY OF THE INVENTION

It is an object of the present invention to provide an ink fountain apparatus for a printing press, which can always maintain the gap between the circumferential surface of the ink fountain roller and the ink blade at a constant value.

It is another object of the present invention to provide an ink fountain apparatus for a printing press, in which a decrease in printing density accompanying high-speed printing is prevented.

It is still another object of the present invention to provide an ink fountain apparatus for a printing press, which can be easily cleaned by setting the ink fountain to be capable of being opened/closed.

According to the present invention, there is provided an ink fountain apparatus for a printing press, comprising an ink fountain roller for supplying a printing ink to a plate cylinder, an ink fountain which has an ink blade disposed to have a predetermined gap with a circumferential surface of the ink fountain roller and is movable forward and backward to approach to and separate from the circumferential surface of the ink fountain roller, follow-up means fixed to the ink fountain and contacting the circumferential surface of the ink fountain roller to follow up a shape of the circumferential surface of the ink fountain roller, and biasing means for biasing the ink fountain toward the circumferential surface of the ink fountain roller.

DETAILED DESCRIPTION OF THE PREFERRED EMBODIMENT

Figure 1:
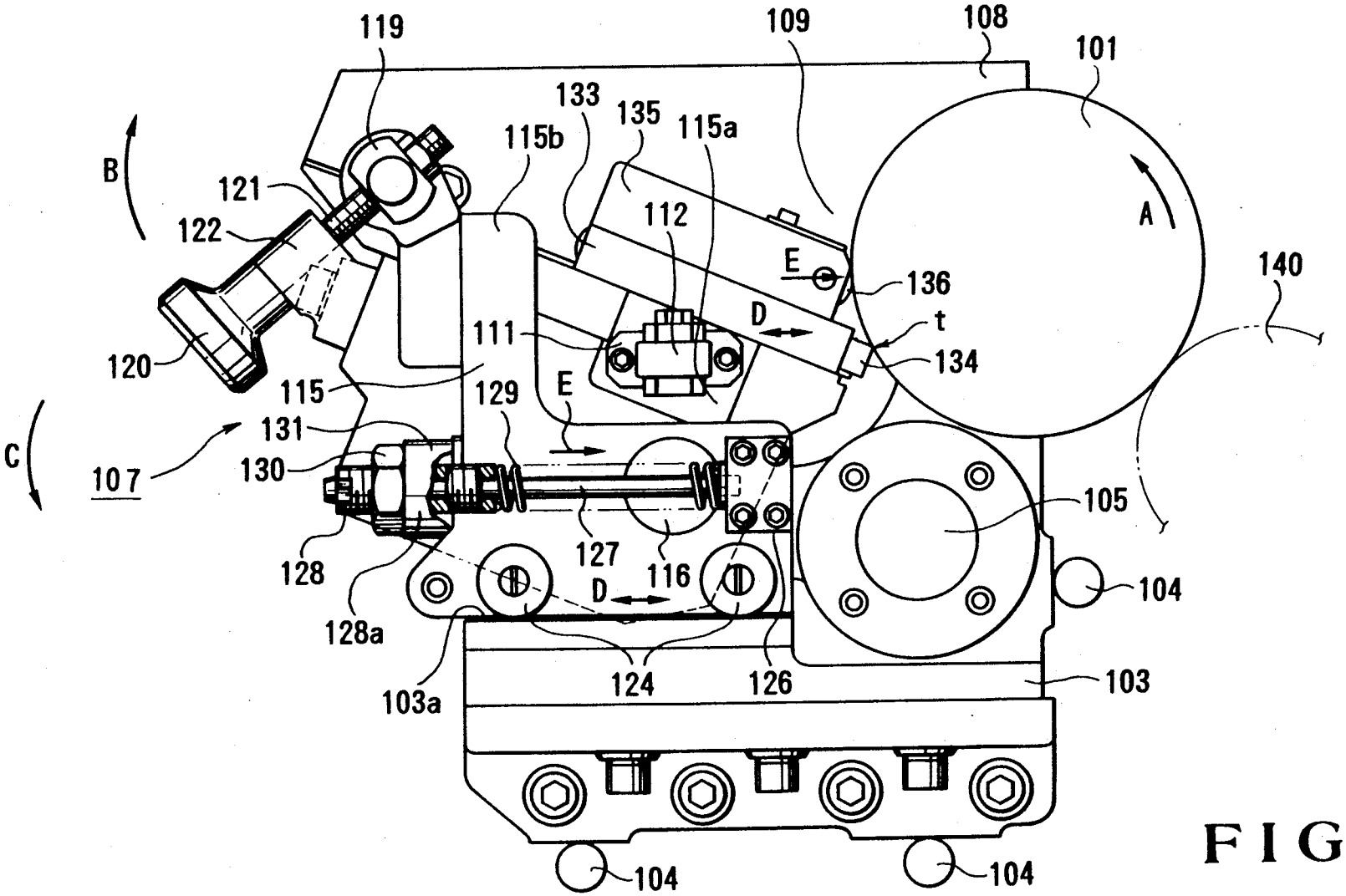
FIG. 1 is a side view of an ink fountain apparatus for a printing press according to an embodiment of the present invention.
Figure 2:
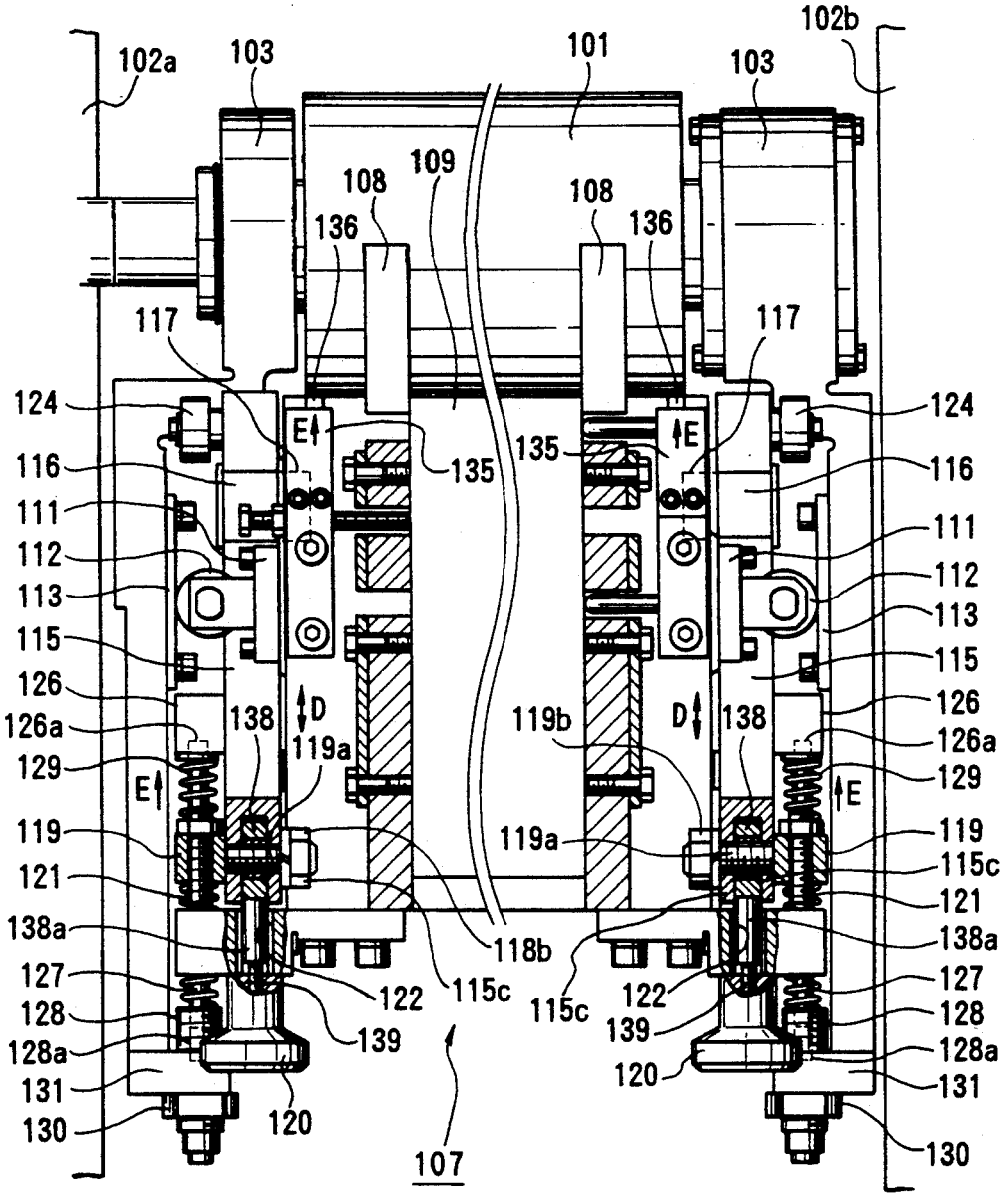
FIG. 2 is a plan view of the ink fountain apparatus for the printing press according to the embodiment of the present invention.
Figure 3:
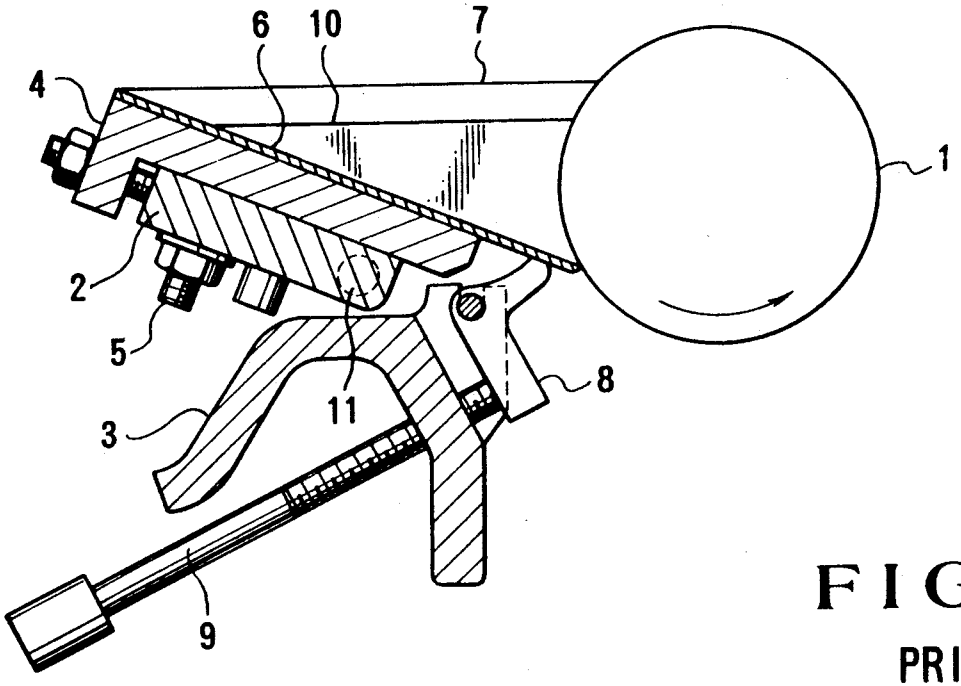
FIG.3 PRIOR ART
FIG. 3 is a sectional view of a conventional ink fountain apparatus for a printing press.

The preferred embodiment of the present invention will be described with reference to the accompanying drawings. FIGS. 1 and 2 show an ink fountain apparatus for a printing press. Referring to FIGS. 1 and 2, an ink fountain roller 101 supplies an ink to a plate cylinder with a large number of rollers (not shown) through an ink ductor 140. The ink fountain roller 101 is rotatably supported by a base table frame **102*a* on one side and between a pair of sub frames 103 on two sides and is rotated in a direction of an arrow A in FIG. 1. The pair of sub frames 103 are prevented from rotation by a plurality of pins 104 provided to stand on the base table frame 102***a* and a base table frame 102*b* and fixed as they are coupled to each other by a round stay 105. A pair of right and left thick-walled ink embankments 108, each having a triangular shape when seen from its side, are fixed at the upper surface of an ink fountain body 107. An ink (not shown) is stored in an ink fountain 109 defined by the thick-walled ink embankments 108, the upper surface of the ink fountain body 107, and the circumferential surface of the ink fountain roller 101.

A pair of first cam followers 112 are respectively pivotally supported on a pair of right and left brackets 111 fixed on the two side surfaces of the ink fountain body 107. The first cam followers 112 respectively contact plates 113 fixed to the sub frames 103 to regulate the movement of the ink fountain roller 101 in the axial direction with respect to the ink fountain body 107, thereby serving as a guide of the ink fountain roller 101 in the circumferential direction. A pair of L-shaped side frames 115 are disposed on the two side surfaces of the ink fountain body 107. A pair of support pins 116 are provided on the inner side surfaces of stationary arms 115*a* of the pair of L-shaped side frames 115, respectively. The projecting ends of the support pins 116 are fitted in fitting holes 117 formed in the side surfaces of the ink fountain body 107. Thus, the ink fountain body 107 is supported between the side frames 115 to be pivotal about the support pins 116.

The distal end portion of an arm 115*b* of each side frame 115 has a pair of clamp pieces 115*c*. A bolt-shaped bracket 119 having a threaded portion only at the distal end portion of its shaft 119*a* is fixed through the pair of clamping pieces 115*c* by a nut 119*b*. A bolt 121 for adjusting a gap t between an ink blade 134 (to be described later) and the circumferential surface of the ink fountain roller 101 is screwed into each bracket 119 in the circumferential direction of the ink fountain roller 101. A flange-shaped pivotal member 138 clamped between the pair of clamp pieces 115*c* is pivotally axially supported on the shaft 119*a* of the bracket 119, and a cylindrical hand attaching portion 138*a* having a threaded inner surface is formed on the circumferential surface of each pivotal member 138. The distal end portion of a screw 139 having a rear end portion fixed to a handle 120 is screwed into the handle attaching portion 138*a* of the pivotal member 138. The screws 139 are moved forward and backward in accordance with the rotating operation of the corresponding handles 120.

Hence, while the handles 120 are loosened, when the handle attaching portions 138*a* are engaged with U-shaped grooves 122 in the ink fountain body 107 and the handles 120 are rotated to be clamped until they contact the ink fountain body 107, the ink fountain body 107 is fixed at the printing position shown in FIGS. 1 and 2.

To clean the ink fountain 109, the handles 120 are rotated to be loosened, and the handle attaching portions 138*a* are removed from the U-shaped grooves 122 of the ink fountain body 107. The removed handles 120 are pivoted in a direction of an arrow B in FIG. 1 to release the ink fountain body 107 and the side frames 115 from each other. Then, the ink fountain body 107 is pivoted in a direction of an arrow C in FIG. 1 and cleaned.

A plurality of second cam followers 124 pivotally supported on the lower portion of each side frame 115 contact a horizontal surface 103*a* of the corresponding sub frame 103, and the side frames 115 are disposed on the sub frames 103 by the second cam followers 124. The side frames 115 and the ink fountain body 107 fixed to the side frames 115 are movable forward and backward in directions indicated by a double-headed arrow D, i.e., to approach to and separate from the circumferential surface of the ink fountain roller 101.

A fitting hole 126*a* is formed in a bracket 126 fixed on the side surface of each side frame 115, and one end of a guide rod 127 is fitted in the fitting hole 126*a*. The other end of the guide rod 127 is engaged in an engaging hole 128*a* in an adjustment bolt 128 to be movable forward and backward. The adjustment bolt 128 is threadably engaged with a bracket 131 fixed at the end portion of each sub frame 103 opposite to the ink fountain roller 101. A compression spring 129 is mounted on each guide rod 127. One end of the compression spring 129 contacts the corresponding bracket 126 and its other end contacts the corresponding adjusting bolt 128. The spring forces of the compression springs 129 are adjusted by adjusting the moving amounts of the adjusting bolts 128. The side frames 115 are biased in a direction indicated by each arrow E by the spring forces of the compression springs 129 with respect to the sub frames 103, and the side frames 115 are movable forward and backward on the sub frames 103 in the directions of the double-headed arrow D, as described above. Thus, the side frames 115 and the ink fountain body 107 are always biased toward the ink fountain roller 101.

A blade table 133 is mounted on the upper surface of the ink fountain body 107 throughout almost the entire surface of the ink fountain roller 101 in the longitudinal direction, and an ink blade 134 having a predetermined gap t between its distal end and the circumferential surface of the ink fountain roller 101 is provided on the blade table 133. A pair of bearing tables 135 are mounted on two sides of the upper surface of the blade table 133, and follow-up bearings 136 are rotatably supported on the distal ends of the bearing tables 135. Since the ink fountain body 107 and the side frames 115 are biased toward the ink fountain roller 101 by the compression springs 129, as described above, the follow-up bearings 136 contact the circumferential surface of the ink fountain roller 101 to maintain the predetermined gap t between the ink blade 134 and the circumferential surface of the ink fountain roller 101.

The operation of the ink fountain apparatus for the printing press which has the arrangement as described above will be described. Because of the biasing forces of the compression springs 129 in the direction of each arrow E, the side frames 115 and the ink fountain body 107 are biased in the direction of each arrow E, i.e., toward the circumferential surface of the ink fountain roller 101, and the follow-up bearings 136 contact the circumferential surface of the ink fountain roller 101. With this arrangement, when the ink fountain roller 101 is expanded by heat generation, the ink fountain body 107 is slightly moved through the follow-up bearings 136 in a direction opposite to each arrow E against the biasing forces of the compression springs 129 by a distance corresponding to the expansion of the ink fountain roller 101. When the ink fountain body 107 is slightly moved, the follow-up bearings 136 are also slightly moved by the same distance, and the gap between the ink blade 134 and the circumferential surface of the ink fountain roller 101 is maintained at a predetermined value t of initial setting despite the expansion of the ink fountain roller 101.

Assume that a printing operation is completed, that the printing press is stopped, and that a certain period of time has elapsed. Then, heat generated in the ink fountain roller 101 is dissipated to shrink it. Thus, the follow-up bearings 136 follow up the circumferential surface of the ink fountain roller 101, and the ink fountain body 107 is slightly moved in the direction of each arrow E. Accordingly, the gap between the ink blade 134 and the circumferential surface of the ink fountain roller 101 is maintained at the predetermined value t of initial setting.

In this embodiment, the position of the ink blade 134 and that of the follow-up bearings 136 are shifted from each other in the circumferential direction of the ink fountain roller 101, i.e., such that the angle of the ink blade 134 from the axis of the ink fountain roller 101 and the angle of the follow-up bearings 136 from the axis of the ink fountain roller 101 are different. However, if the ink blade 134 and the follow-up bearings 134 are disposed at the same angle, the gap t between the ink blade 134 and the circumferential surface of the ink fountain roller 101 can be set more precisely.

As has been described above, according to the present invention, the follow-up rolls follow the deformation of the ink fountain roller caused by heat, and thus the ink fountain is moved forward/backward to always maintain the gap between the ink blade and the circumferential surface of the ink fountain roller precisely at a predetermined value. Therefore, the amount of ink supplied from the ink fountain and the thickness of the ink film on the surface of the ink fountain roller can be held at predetermined values, thereby eliminating a decrease in density accompanying high-speed printing.

What is claimed is:

1. An ink fountain apparatus for a printing press, comprising:

an ink fountain roller for supplying a printing ink to a plate cylinder;

an ink fountain which has an ink blade disposed to have a predetermined gap with a circumferential surface of said ink fountain roller and is linearly shifted from said circumferential surface of said ink fountain roller;

follow-up means fixed to said ink fountain and contacting said circumferential surface of said ink fountain roller so as to linearly shift said ink fountain with respect to a change in shape of said circumferential surface of said ink fountain roller;

wherein said ink fountain is provided on an ink fountain body movable forward and backward to approach to and separate from said circumferential surface of said ink fountain roller, and said ink blade and said follow-up means are fixed to said ink fountain body such that said ink blade has the gap with said ink fountain roller while said follow-up means contacts said ink fountain roller;

biasing means for biasing said ink fountain toward said circumferential surface of said ink fountain roller;

a pair of side frames, biased toward said circumferential surface of said ink fountain roller by said biasing means, for holding said ink fountain body from two sides;

guide means for guiding at least one of said pair of side frames to be movable forward and backward to approach to and separate from said circumferential surface of said ink fountain roller; and fixing means for fixing said side frames and said ink fountain body;

wherein said ink fountain body is biased by said biasing means through said side frames while being integrally fixed with said side frames by said fixing means;

wherein said ink fountain body is pivotally axially supported between said side frames by shafts so as to be pivoted in a direction to separate from said circumferential surface of said ink fountain roller when said fixing means is released.

2. An apparatus according to claim 1, wherein said follow-up means comprises a roll which is rotated while contacting said circumferential surface of said ink fountain roller.

3. An apparatus according to claim 1, wherein said follow-up means is disposed at least one on one side portion of said ink fountain roller.

* * * * *